US005720138A

United States Patent [19]

Johnson

[11] Patent Number: 5,720,138

[45] Date of Patent: Feb. 24, 1998

[54] METALLIC WALL FRAMING, METHOD AND APPARATUS FOR PRODUCING SAME

[76] Inventor: David L. Johnson, 83 Windbeam Ave., Ringwood, N.J. 07456

[21] Appl. No.: 974,627

[22] Filed: Nov. 12, 1992

[51] Int. Cl.[6] ..... H02G 3/08

[52] U.S. Cl. ..... 52/220.7; 52/241; 52/656.1

[58] Field of Search ..... 52/241, 238.1, 52/239, 240, 664, 274, 690, 127.1, 656.1, 220.1, 220.8, 220.7; 174/48, 49

[56] References Cited

U.S. PATENT DOCUMENTS

| | | | |
|---|---|---|---|
| 659,350 | 10/1900 | Osborn | 52/220.1 |
| 1,762,112 | 6/1930 | White . | |
| 2,067,403 | 1/1937 | Leh | 52/220.1 X |
| 2,173,721 | 9/1939 | McGee | 72/46 |
| 2,966,708 | 1/1961 | Freeman, Jr. | 20/95 |
| 3,001,615 | 9/1961 | Ries | 189/35 |
| 3,146,298 | 8/1964 | Ceglia | 52/220.1 X |
| 3,312,770 | 4/1967 | McKenna et al. | 174/48 |
| 3,332,648 | 7/1967 | Selinder | 174/48 X |
| 3,421,353 | 1/1969 | Franc . | |
| 3,536,345 | 10/1970 | Leifer | 287/54 |
| 3,680,271 | 8/1972 | Satchell | 52/656 |
| 3,845,601 | 11/1974 | Kostecky | 52/690 X |
| 3,892,095 | 7/1975 | Vankuik et al. | 52/220.1 X |
| 4,232,845 | 11/1980 | Turner | 52/220.1 X |
| 4,236,473 | 12/1980 | Belt . | |
| 4,297,524 | 10/1981 | Fork | 52/220.1 X |
| 4,385,477 | 5/1983 | Walls et al. | 52/220.1 X |
| 4,433,204 | 2/1984 | Wuertz | 174/48 |
| 4,448,004 | 5/1984 | Thorsell | 52/241 |
| 4,536,612 | 8/1985 | Domigan | 52/220.1 X |
| 4,805,364 | 2/1989 | Smolik | 52/241 |
| 4,809,476 | 3/1989 | Satchell | 52/656.1 |
| 4,854,096 | 8/1989 | Smolik | 52/241 |
| 4,918,899 | 4/1990 | Karytinos | 52/690 |
| 5,029,462 | 7/1991 | Wakahara et al. . | |
| 5,203,132 | 4/1993 | Smolik | 52/241 |
| 5,222,335 | 6/1993 | Petrecca | 52/241 X |
| 5,243,134 | 9/1993 | Nattel | 174/48 X |
| 5,287,665 | 2/1994 | Rath | 174/48 X |

FOREIGN PATENT DOCUMENTS

| | | | |
|---|---|---|---|
| 365773 | 5/1990 | European Pat. Off. | 52/238.1 |
| 966578 | 8/1957 | Germany | 52/656.1 |
| 2 169 937 A1 | 7/1986 | United Kingdom . | |

*Primary Examiner*—Kenneth J. Dorner
*Assistant Examiner*—Jerry Redman
*Attorney, Agent, or Firm*—David G. Conlin; Peter F. Corless

[57] ABSTRACT

Metallic track members having locking slots designed for receiving and retaining metallic stud members that contain construction aids enable the assembly of metallic frames used in the construction of buildings. A flat metallic strip is converted to a W-shaped metallic track member by a series of stamping, bending and severing steps. U-shaped stud members, manufactured in a similar manner are inserted into the track members and held relatively stable by upper and lower track members. An upper track member can be the same shaped design as the lower member or can be U-shaped with stud retaining means into which the stud members can slip-fit. The process for manufacturing is adaptable for computer aided manufacturing using data from the computer aid design of the building. Manufacturing equipment for the manufacture of the construction members is relatively light-weight and can be transported to the job site.

25 Claims, 8 Drawing Sheets

METALLIC WALL FRAMING, METHOD AND APPARATUS FOR PRODUCING SAME

This invention relates to metallic wall framing for use in residential and commercial buildings. More particularly, it relates to metal framing that comprises upper and lower metallic track members and metallic vertical members connecting the upper and lower track members, the individual members, a method for producing the individual members from flat metallic stock and a portable apparatus for producing the members from flat metallic stock.

BACKGROUND OF THE INVENTION

Framing used in residential and commercial buildings generally have upper and lower horizontal members which are generally spaced apart vertically by a distance that corresponds to the vertical wall height. The upper and lower members which are referred to as "plates", or "runners" or "tracks", particularly when materials other than wood are used. In this application, the term "track member" is used and refers to the horizontal members. The vertical members of the framing that connect the upper and lower tracks are referred to as "studs" or "risers". In the context of the present invention the vertical members for connecting the upper and lower tracks members are referred to as a "stud members".

In commercial or residential buildings in which fire proofing or fire resistance is desired, conventional wood framing can not be used. As a result, there have been numerous metallic framing designs proposed, such as those disclosed in U.S. Pat. Nos. 2,173,721; 2,966,708; 3,001,615; 3,536,345; 3,680,271; 4,805,364; 4,854,096 and 4,918,899. However, there remains a need for a metallic track members which are capable of easily receiving and securely retaining studs and which track can be fabricated from flat metallic sheet at the job site and which can be assembled into construction framing with a minimum of labor and material costs. Prior metallic construction members such as those illustrated in the above patents lacked one or more of the above qualities. Certain members could not be readily manufactured at the job site. In certain types of members the stud member tended to move in one or more directions. Other designs of metallic construction members resulted in excessive field assembly time. Still other types of designs were cumbersome to transport from the production facility at which they were fabricated to the job site where they were to be used.

It is believed, therefore, that metallic members which obviates many of the disadvantages of prior metallic framing members would be an advancement in the art.

SUMMARY OF THE INVENTION

In accordance with one aspect of this invention there is provided a metallic longitudinal track that comprises first and second substantially identical and parallel vertical wall sections forming opposing vertical walls of the track, first and second substantially identical horizontal base sections of the track having a first width and projecting at about 90° from the corresponding adjacent wall sections at one extremity along the entire length thereof, first and second substantially identical vertical intermediate sections and projecting angularly from an extremity of adjacent base sections opposite to the respective wall sections and having transverse cross-sections in the shape of the sides and top of a truncated isosceles triangle; the intermediate sections have a plurality of transversely aligned locking slots for receiving and retaining portions of vertical transverse metallic stud members and a third horizontal base section having a second width between the vertical intermediate sections.

In accordance with another aspect of this invention there is provided a metallic stud member having a predetermined length comprising first and second spaced apart parallel wall sections extending the length of the stud member, a transition section perpendicular to and connecting the wall sections at one extremity of each wall section and flange sections projecting perpendicular from the opposing extremity of each corresponding wall section. The transition section has at least one construction aids at predetermined locations selected from the group consisting of:

i) a first receiving means capable of receiving and securing a metallic transverse member interconnecting an adjacent transition section of an adjacent stud member, ii) a second receiving means capable of receiving and securing a mounting member for an electrical box, iii) a passageway for enabling an electrical conduit to traverse said stud member, iv) a pair of slots for receiving and securing end tabs of transverse framing for a door or a window and v) an opening at the lower extremity of the transition section for passage of utility conduits.

In still other embodiments of this invention there are provided methods of producing the metallic track and stud members from a relatively flat metallic sheet. Additional embodiments provide portable mechanisms for producing the metallic track and stud members at the job site. Still other embodiments provide framing that comprises a pair of vertically spaced apart track members as set forth above and a plurality of U-shaped metallic stud members having the construction aids as described above and construction aids for mounting internal walls.

DESCRIPTION OF THE PREFERRED EMBODIMENTS

For a better understanding of the present invention together with other and further objects, advantages and capabilities thereof, reference is made to the following detailed description and appended claims in connection with the above summary of the invention and the brief description of the drawings.

The track and stud members are preferably made from galvanized steel However, any fire resistant metal sheet can be used which can be formed into the required shape without the creation of undue stress in the member. A typical preferred material is a sheet of 16 gage galvanized steel. In many instances the track members will be produced in a standard length, such as 12 feet, and transported to the job site, however, as hereafter described, portable on-site production equipment can be used to fabricate the track members from a roll of galvanized steel. The portable production facility is particularly useful when the amount of framing exceeds about 20,000 linear feet.

A typical roll of suitable metallic sheet from which the track members are fabricated will have a preferred a width of about 12 inches. In a similar fashion, the stud members can also be formed from a flat sheet having a typical width of about 7 inches.

Figure 1:
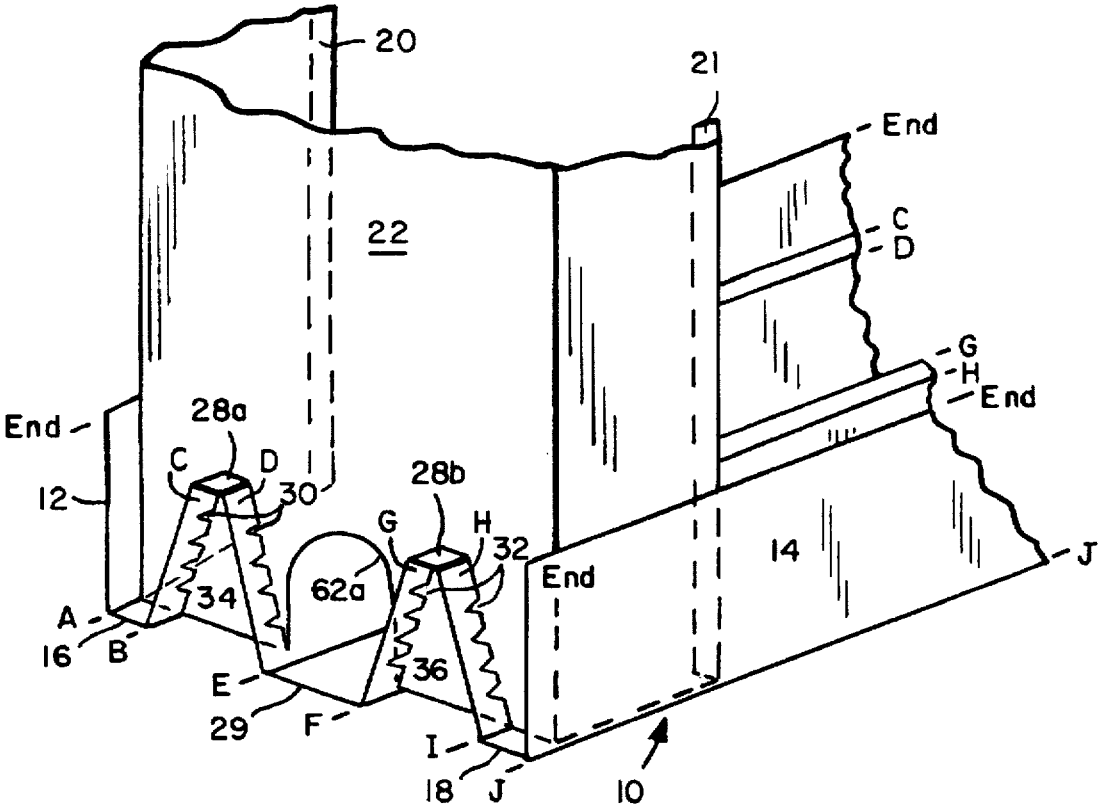
FIG. 1 is a fragmentary perspective view showing a lower track member interconnected with a vertical U-shaped stud member.
Figure 2:
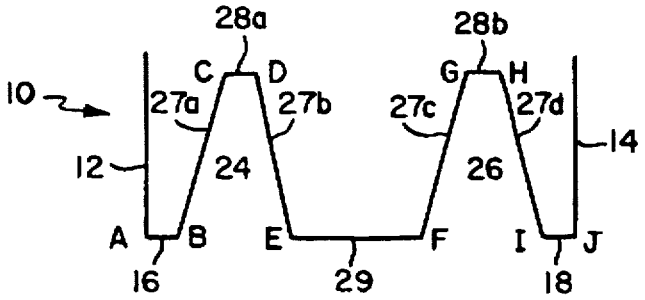
FIG. 2 is an end view of a track member.

With particular reference to FIGS. 1 and 2, a lower track member 10 has a first wall section 12, and a second substantially identical and parallel vertical wall section 14 that form opposing vertical walls of the track. A first horizontal base section 16 and a second horizontal base section 18 receives flange sections 20, 21 of the stud member 22. The first base section 16 and the second base section 18 are fabricated sufficiently narrow to prevent the stud member 22 from moving appreciably in the transverse direction. The base sections, 16, 18 project at about 90° from corresponding adjacent wall sections 12, 16 at the extremities A, J. A first vertical intermediate member 24 projects from extremity B of adjacent base section 16. A second vertical intermediate member 26 which is substantially identical to first vertical intermediate member 24 projects from the corresponding extremity I of the second base section 18. Both intermediate members have a transverse cross-sections in the shape of the sides 27*a*, 27*b*, 27*c*, 27*d* and tops 28*a*, 28*b* of truncated isosceles triangles. A third horizontal base section 29 extends between the vertical intermediate members 24 and 26. Thus, as is portrayed in FIG. 2 the track member 10 is a W-shaped member. The first intermediate member has a locking slot 30 as shown in detail in FIG. 3. The second intermediate member 26 has a similar locking slot 32. The locking slots 30, 32 receive and retain portions 34, 36 of the transverse stud member 22. A series of serrations extending from locking slot 30 form a series of locking teeth; 38 *a–d*, 39 *a–d*, 40 *a–d* and 41 *a–d*, which enable a lower portion 34 of stud member 22 to be inserted and retained in locking slot 30. In similar fashion another lower portion 36 of stud member 22 is retained in locking slot 32. An upper track member 37, FIG. 7 has a configuration similar to the lower track member 10 and receives and retains corresponding upper extremities of the stud member 22 similar to the lower track member 10. The combination of the upper and lower track members having locking slots similar to those shown as 30, 32 in FIG. 1 and 3 and the first and second base members similar to those shown as 16, 18 in FIG. 2 prevent the stud members from moving vertically, horizontally or longitudinally. Additionally, the upper and lower track members and the stud members can be assembled and moved into a desired position thereby reducing the time required for constructing wall framing of a building.

Figure 4:
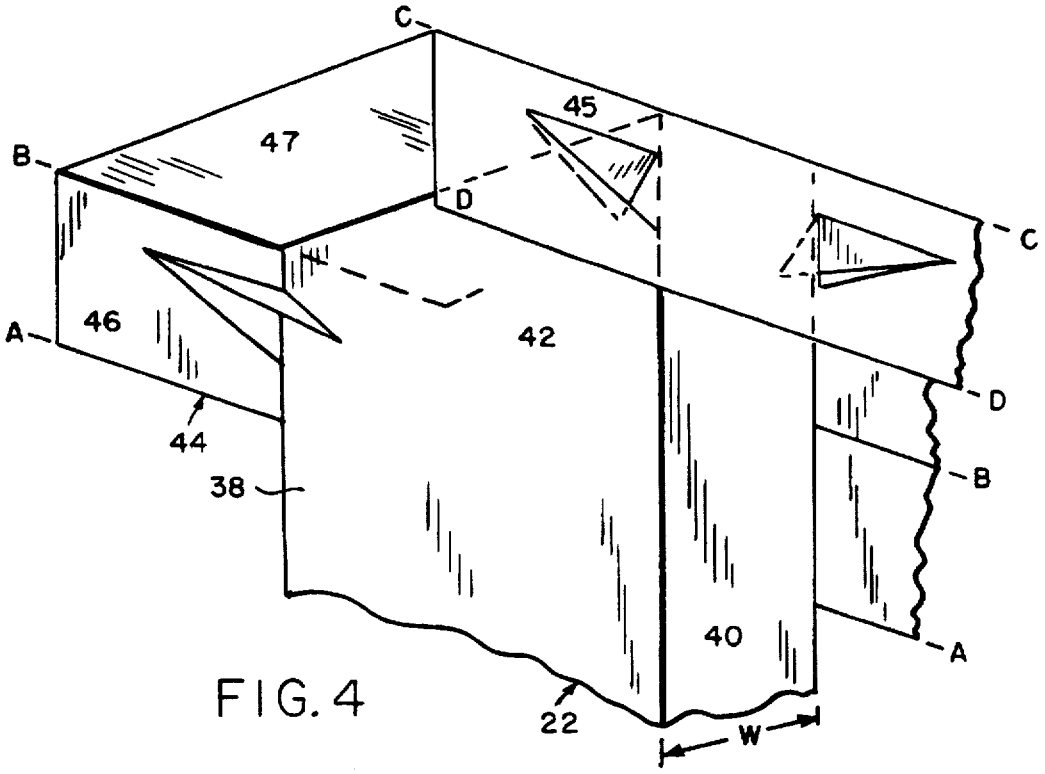
FIG. 4 is a broken-away fragmentary perspective view showing an optional upper track member connected to the upper end of a slide member of this invention.
Figure 6:
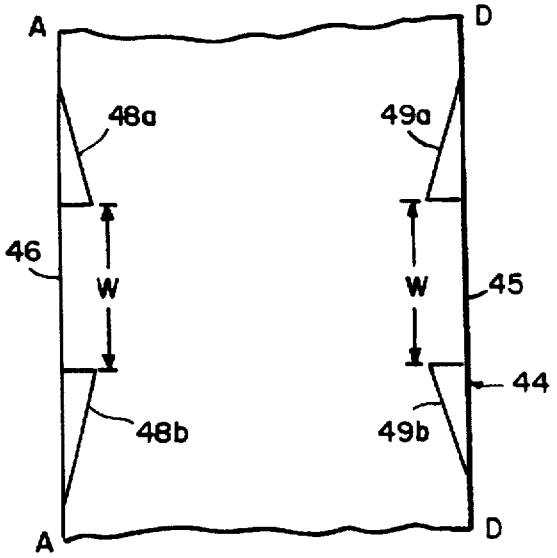
FIG. 6 is a view of a segment of the optional upper track showing stud retainer of the optional upper track.
Figure 5:
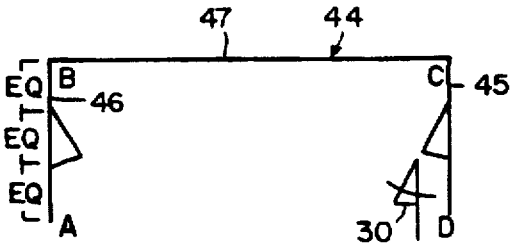
FIG. 5 is an end view optional upper track member.
Figure 16:
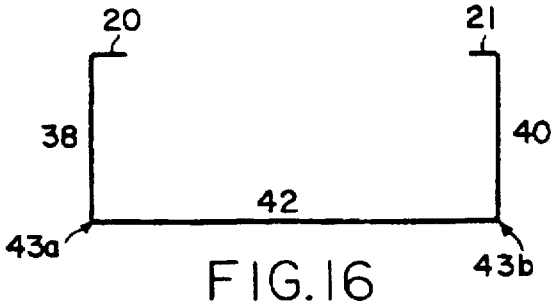
FIG. 16 is a cross-sectional view of a stud member taken along line A—A in FIG. 10.

With particular reference to the fragmental views of FIG. 4 and top view FIG. 16, the U-shaped stud member has parallel wall sections 38, 40 with a transition section 42 connecting wall sections 38, 40. As is shown in FIG. 4 the stud member is inserted into an alternate upper track 44. With particular reference to FIG. 5 and 6, the alternate upper track 44 has vertical walls 45, 46 and upper track transition section 47 between the walls 45, 46. Stud retaining means 48*a*, 48*b* project from wall 45. In a similar manner stud retaining means 49*a*, 49*b* project from wall 46 and are aligned with the stud retaining means 48*a*, 48*b* of wall 45 thereby enabling the wall sections 48, 40 of stud member 22 to be inserted between the stud retaining means 48*a*, 48*b*, 49*a* and 49*b*.

Figure 7:
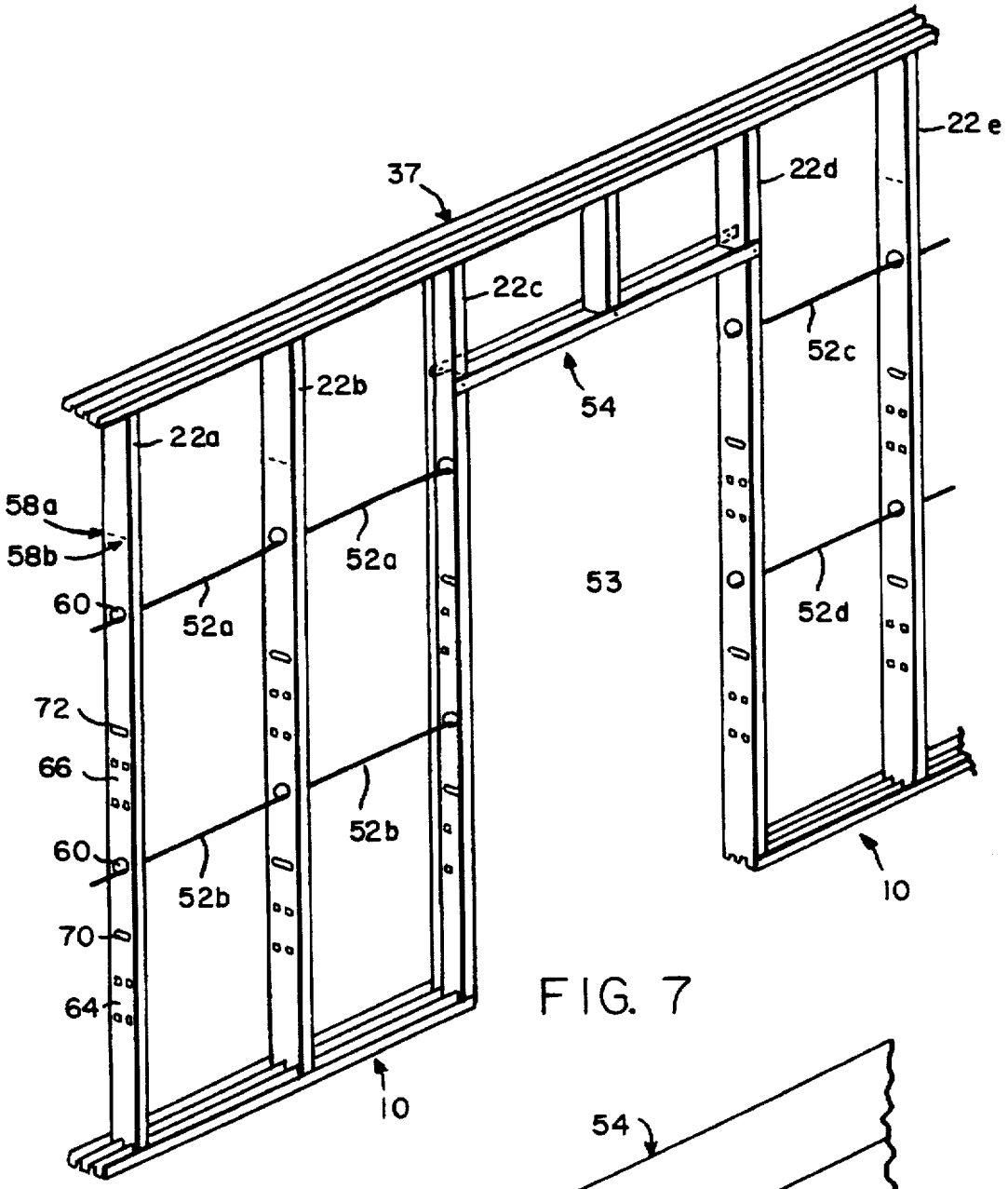
FIG. 7 is a perspective view illustration framing utilizing upper and lower track members of the present invention and stud members of the present invention.

With particular reference to FIG. 7 there is shown a wall framing segment 50 utilizing the concepts of this invention. Lower track member 20 receives and retains a plurality of stud members 22*a* through 22*e*. An upper track member 37, substantially identical to lower track member 10, receives stud members 22*a* through 22*e*. Angle reinforcing members 52*a* and 52*b* interlock stud members 22*a*, 22*b* and 22*c*. Similarly, angle reinforcing members 52*c* and 52*d* interlock stud members 22*c* and 22*d*, a door framing member 54 interconnects stud members 52*c* and 52*d*.

Figure 8:
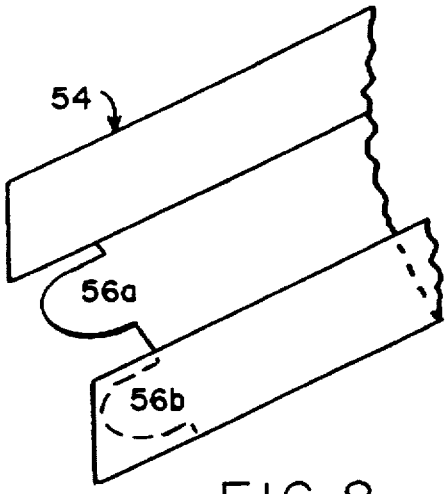
FIG. 8 is fragmentary perspective view of the tabs of a head stock for door or window framing.

FIG. 8 is an end segment of door framing member 54 in which tabs 56*a* and 56*b* are inserted into slots 58*a* and 58*b* of stud 22*c*. The slots in the stud are described with reference to FIG. 20 herein. Similar tabs fit into slots in stud 22*d* and the opposing end of door framing member 54.

Figure 9:
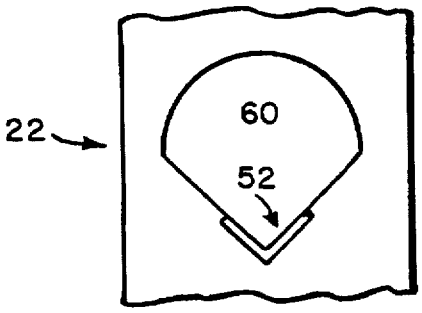
FIG. 9 is a detail view of a typical opening for receiving an angle member which will connect adjacent stud members in an interlocking relationship.

With particularly reference to FIG. 9 there is shown an opening 60 in stud member 22 which receives and retains angle reinforcing member 54.

Figure 10:
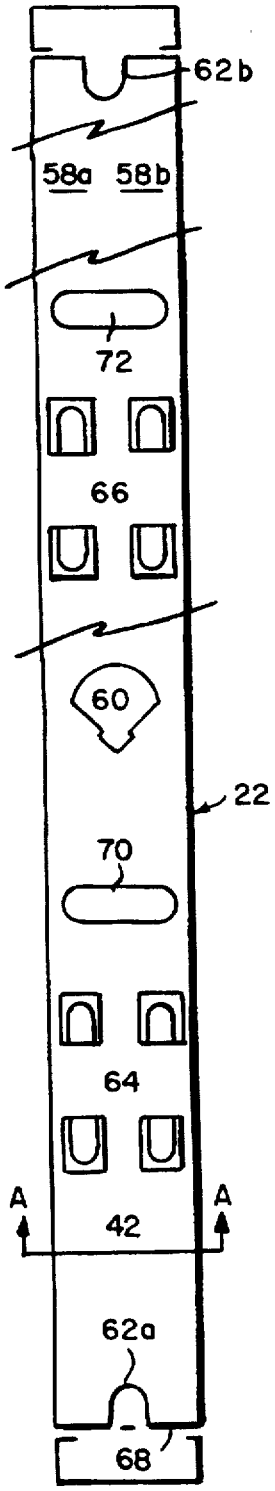
FIG. 10 is a fragmentary side view of a stud member of this invention is made and in which typical construction aids have been stamped.
Figure 18:
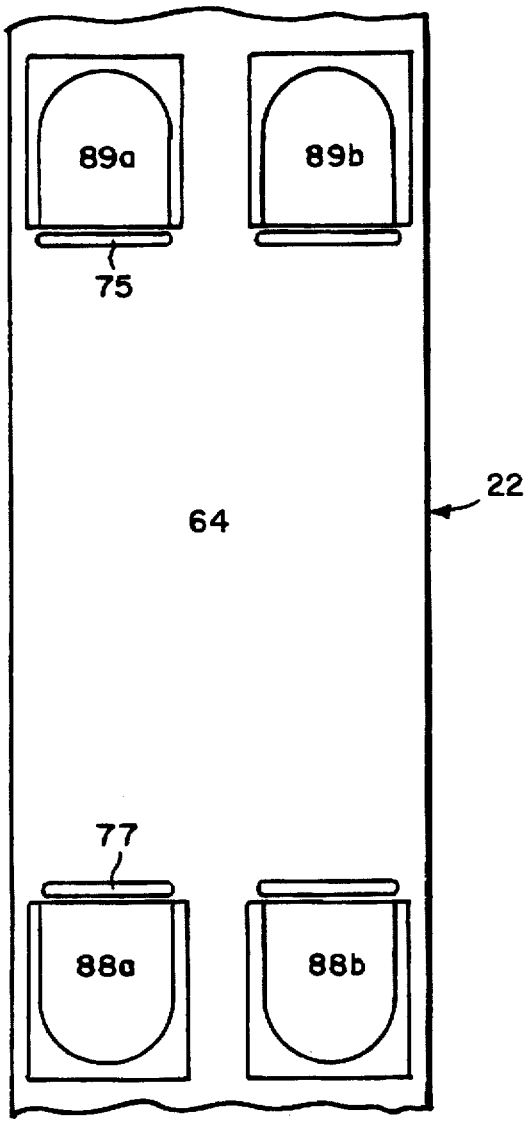
FIG. 18 is a detail view of showing typical openings for clips to retain an electrical outlet boxes.
Figure 17:
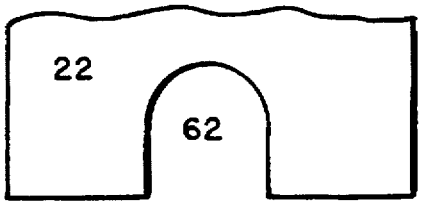
FIG. 17 is a detail view of a typical access opening at the lower end of the stud through which various utility conduits can pass.

With particular reference to FIG. 10, there is shown a fragmentary side view of a stud member 22. On access openings 62*a* and 62*b* which are described in detail in FIG. 17 are a substantially centered in the transition section 42, conduit box receiving stations 64, 66, which are described in detail with reference to FIG. 18 are vertically aligned and are at about 18 inches and 48 inches respectively from the lower end 68 of stud 22. Conduit passageways 70, 72 are detailed with respect to FIG. 19. Opening 60 which was described in detail with respect to FIG. 9 and framing slots 58*a*, 58*b*.

Figure 11:
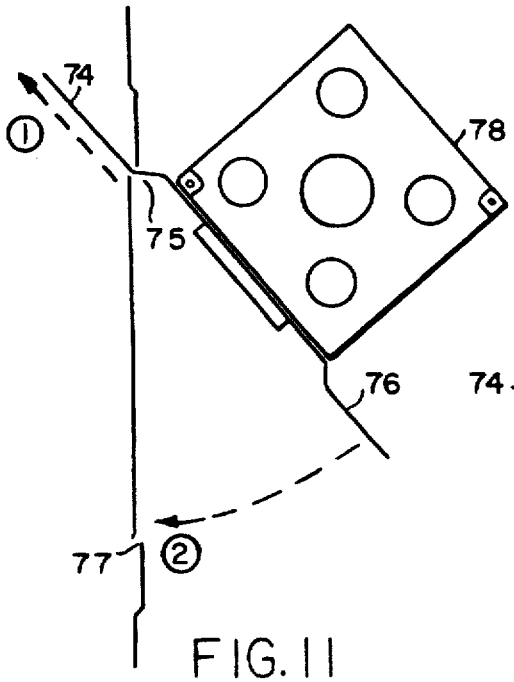
FIG. 11 is a side view showing the initial insertion of retaining clips of an electrical conduit box into the receiving slot of the stud.
Figure 12:
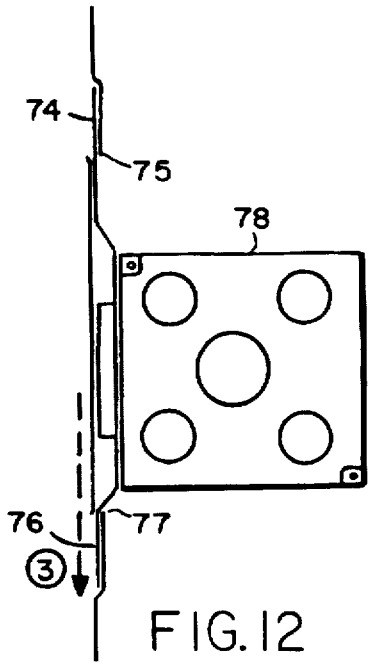
FIG. 12 is a side view showing an electrical conduit box mounted to a stud member.

With particular reference to FIG. 11 the upper conduit box tab 74 2s inserted into upper slot 75 of the conduit box receiving station. After the initial insertion as shown in FIG. 11, the box is rotated so that lower conduit box tab 76 can be inserted in lower slot 77 as shown in FIG. 12. After insertion of the lower conduit box tab 76, the conduit box 78 is lowered and the box 78 is mounted on side of stud 22.

Figure 13:
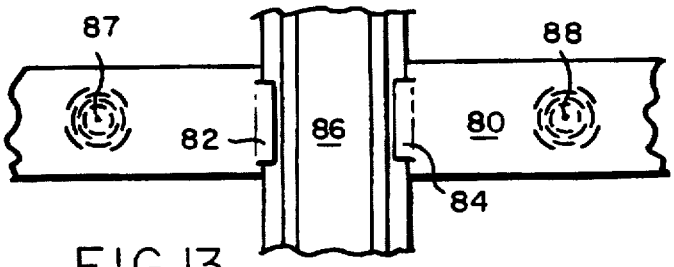
FIG. 13 is a plan view showing a self locking furring channel mounting strip construction aid.
Figure 14:
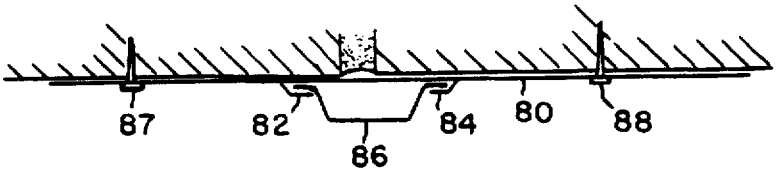
FIG. 14 is a side view showing the self locking furring channel mounting strip construction aid.

With particular reference to FIGS. 13 and 14 there is shown a construction aid that can be used in conjunction with internal wall construction. While the construction aid is shown with respect to mounting upon a masonry or concrete wall which often are not true so that if an internal wall is mounted in a conventional manner the wall will not be true or level with respect to the other wall, the ceiling or the floor of the room. Construction aid comprises strip 80 having projections 82, 84 that provide for receiving and retaining transverse member 86 having a relatively flat surface. Strip 80 is anchored to the underlying wall by anchoring means 87, 88. Shims, not shown, can be used at the anchoring means to provide a surface of member 86 that will enable the internal wall mounted thereupon to be true, thereby enabling the internal wall to be in the proper geometric relationship.

Figure 3:
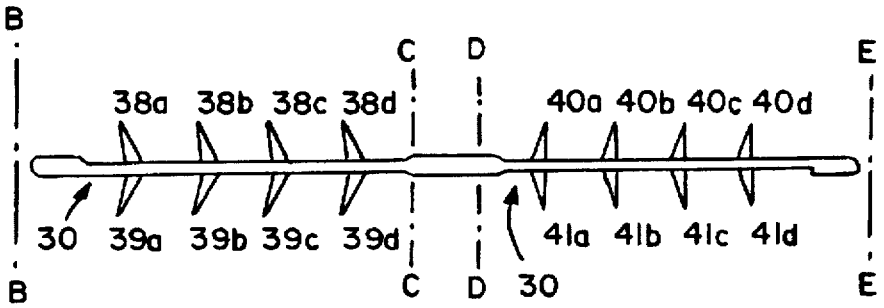
FIG. 3 is a top view of the profile of a typical locking slot utilized in the practice of this invention.
Figure 15:
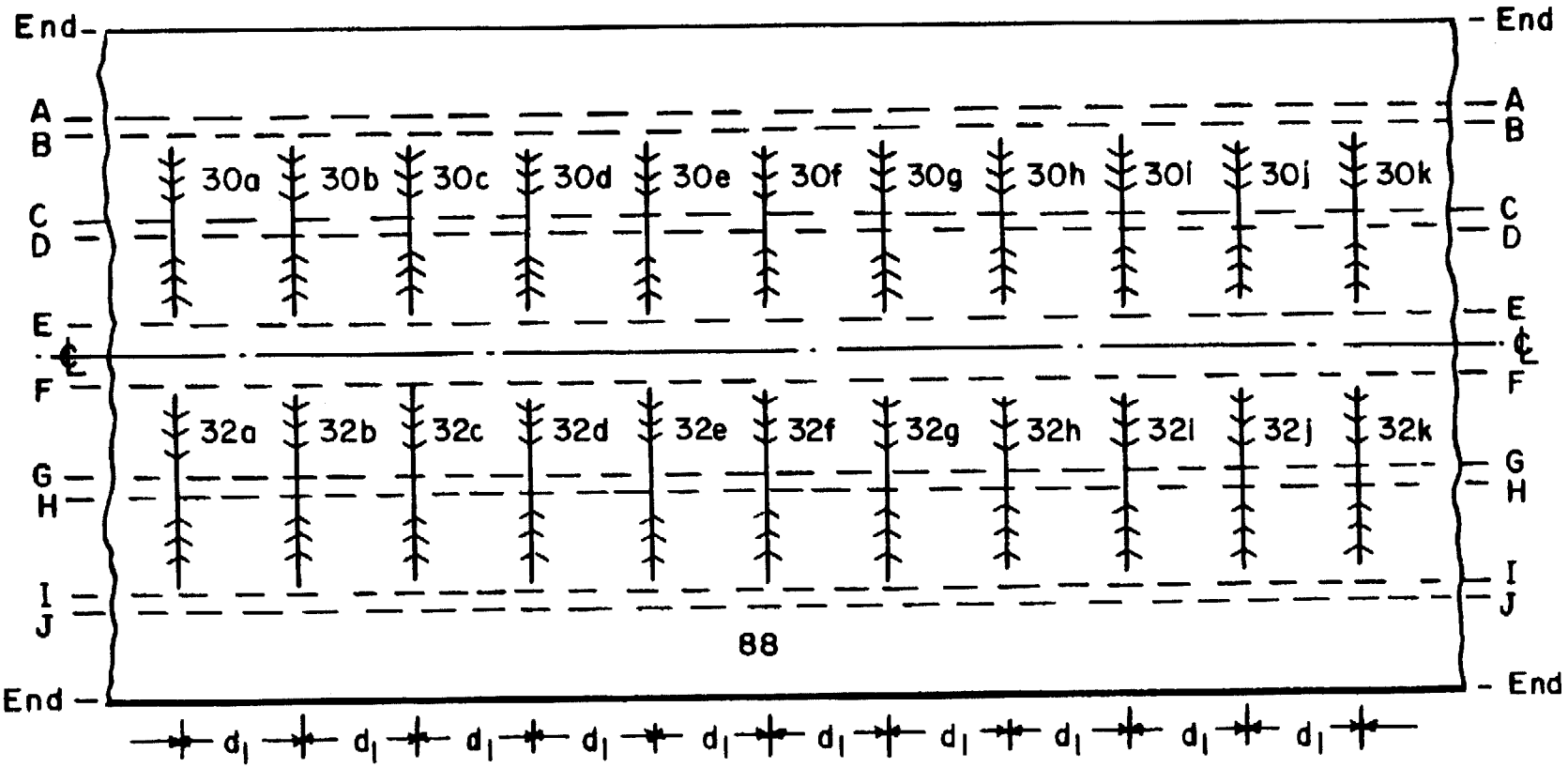
FIG. 15 is a fragmentary top view of a flat metallic plate from which a track member of this invention is made in which typicallocking slots have been stamped.

With particular reference to FIG. 15, there is shown a fragmentary plan view of a metallic plate 88, such as 16 gage galvanized steel, in which a series of locking slots 30 *a–k* and 32 *a–k* are cut the slots are described in detail above with particular reference FIG. 3. A spacing "$d_1$" is shown. The spacings are chosen to enable the studs to have the appropriate spacing to provide construction flexibility A spacing of 2 inches is preferred. The plate 88, after the locking slots have been cut, is heated to a metal deforming temperature and in a series of passes the plate is bent at dotted lines A—A through J—J to form a track having an end view as shown in FIG. 2. The metal deformation produces a track having wall sections 12, 14, first and second base sections 16, 18 and intermediate sections 24, 26, and a third base section 28.

With particular reference to FIG. 16, a cross section taken along line A—A of FIG. 10 the U-shaped metallic stud member 22 has first and second spaced apart parallel wall sections 38, 40 extending the length of the member, a transition section 42 is perpendicular to and connecting the wall sections 38, 40 at the extremities 43*a*, 43*b* of each wall section 38, 40. Flange sections 20, 21 project perpendicular from corresponding wall sections 38, 40. As shown in FIG. 10, the transition section 42 has various construction aids at predetermined locations along the length thereof.

With particular reference to FIG. 17, there is shown a detail view of typical access openings 62. The openings are at the lower and upper ends respectively of the transition section 42 of stud member 22. The openings as shown in FIG. 10 as 62*a*, 62*b* enable the various utility conduits such as water pipes and the like to pass through stud member 22.

With particular reference to FIG. 18, conduit box receiver station 64, comprises vertically aligned conduit box tab receiving means 88*a*, 89*a* which also contain upper and lower slots 75, 77 for receiving tabs from a conduit box 78 as shown in FIGS. 11 and 12. Another pair of identical means 88*b* and 89*b* are located at the opposite side of the transition section 64 of the stud member 22 so that electrical conduit boxes can be mounted for access to either side of the wall that is formed on either side of the framing.

Figure 19:
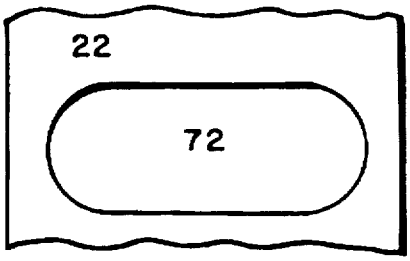
FIG. 19 is a detail view of a conduit passageway for electrical conduit.

With particular reference to FIG. 19 opening 72 in stud 72 is of a sufficient size to enable electrical conduit to be passed through the stud member 22.

Figure 20:
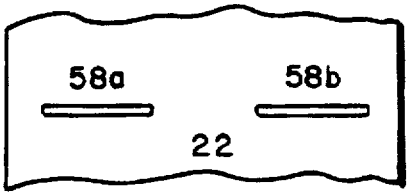
FIG. 20 is a detail view of slots for receiving end tabs of header stock for window and door framing.

With particular reference to FIG. 20 slots 58*a* and 58*b* are sized to receive and retain tab 56*a* and 56*b* of the wall opening framing 54, shown as a door 53 in FIG. 7. If desired, however, similar framing can be used to provide opening for windows.

Figure 21:
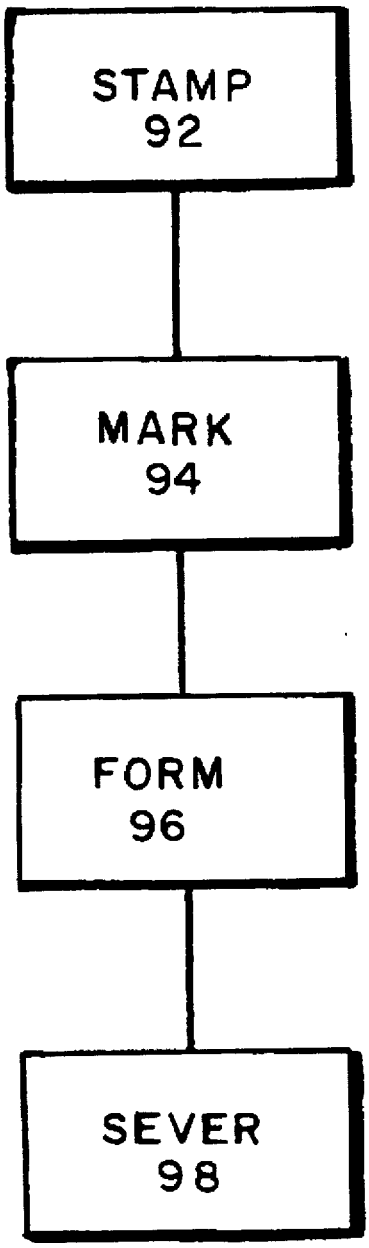
FIG. 21 is a flow diagram illustrating the method of producing the track members of this invention.

FIG. 21 illustrates the process of forming the metallic track members of this invention. A sheet of metallic material such as galvanized steel, cold rolled steel, aluminum, or other metals and metal alloys can be used. The flat metallic sheet material, typically 12 inches in width can be used from a spool or reel. The flat sheet, after being unwound from the spool or reel is stamped at step 92 to produce locking slots as shown in FIG. 3 thereby producing a strip of material as shown in FIG. 15. A first series of indicants are placed at intervals of 24 inches starting at one end of the stamped sheet. A second series of indicants are placed at intervals of 12 inches starting at 12 inches from the same end of the stamped sheet. A third set of indicates are placed at intervals of 16 inches starting at 16 inches from the same end of the stamped sheet. A simple method of providing indicants is to use paint wheels that mark a distinctive line or mark for each series of indicants. For example, a ¼" black line can be used for the first series of indicants, 3/16" red lines for the second series of indicants and ⅛" yellow lines for the third series of indicants are suitable.

Figure 22:
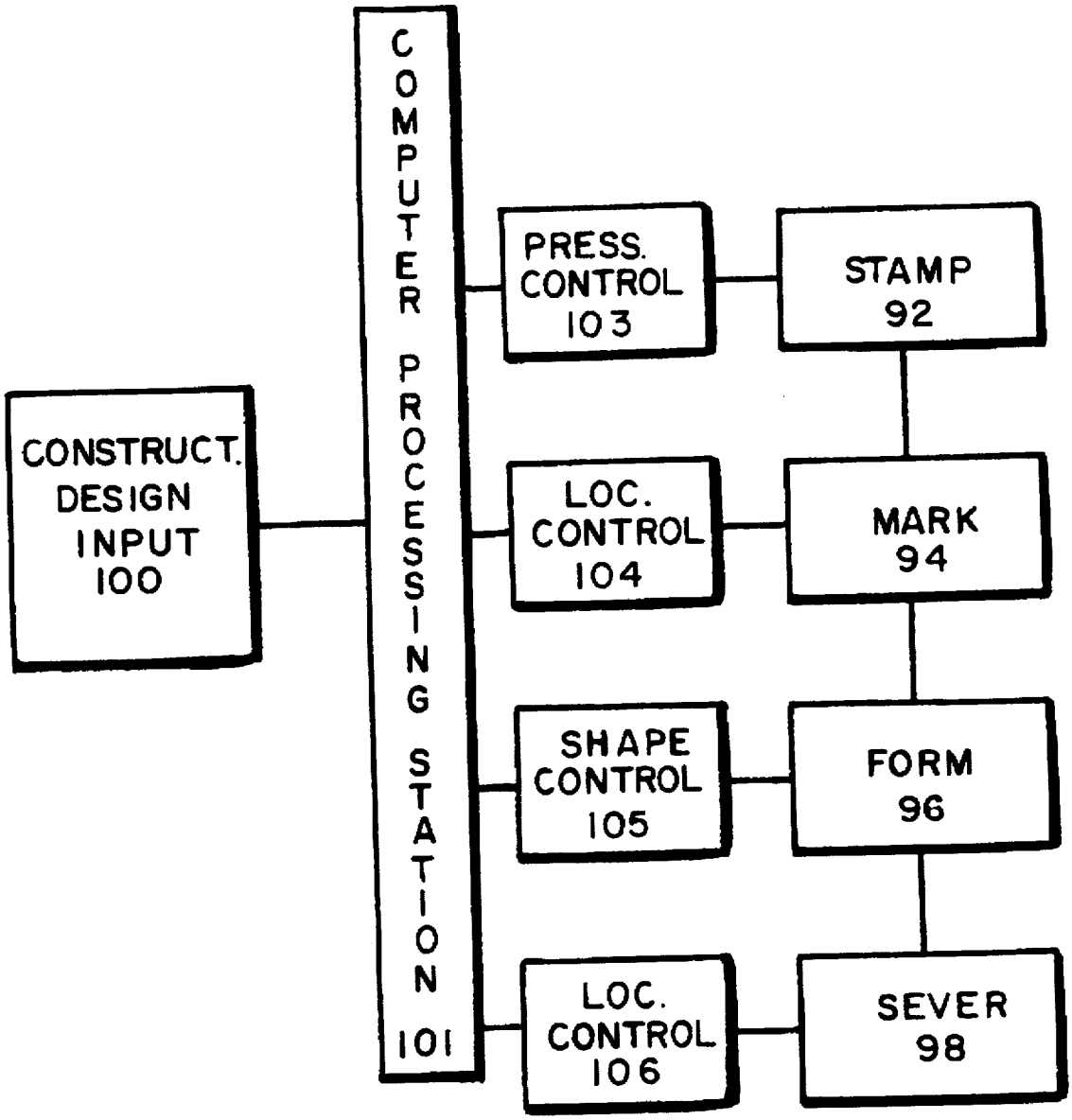
FIG. 22 is a flow diagram illustrating the computer aided manufacturing method and apparatus of this invention.

With particular reference to FIG. 22 the construction design input of the particular building to be built is programmed, either downloaded from the CAD system used to design the building or programmed manually and fed into the computer processing station 101 which yields a series of outputs.

The data relating to the pressure required to stamp a particular metal sheet being processed, which will be dependent upon the thickness of the metal and the material of construction, can be processed and fed to the pressure controller 103. The pressure controller 103 can regulate the stamping station 92 and as explained previously, indicants at preselected locations are useful to assist in the construction. The data for the linear repetitive location of the series of indicants can be processed and fed to location controller 104 which will operate the marking device 94 which will locate the first, second and third sets of indicants on the sheet. The configuration of the track, whether of the type shown in FIG. 2 or the type shown in FIG. 5 is programmed and inputted into the computer processing station 101. The output from the computer processing station provided shape controller 105 which signals the bending wheel station, used to shape the flat sheet into the desired configuration. The input from the design of the building is used to program the length of each segment of track member that is required. The computer station 101 feeds the data to the locating control 106 which provides the desired signals to the severing station 98 that provides a shearing action to cut the processed track member to the lengths required in the building design. Additionally, the input from the building design can be used to provide outputs from the computer processing station to provide the locations of the locking slots. Thus, the location of the studs at the standard spacing can be designed as well as the location and width of wall openings such as doors, windows, floor to ceiling openings can also be fed into the manufacturing design of the track members.

A metallic sheet holding means such as a spool or reel holds the metallic strip prior to the sheet being fed to metal stamper 92 wherein a series of locking slots as shown in FIG. 15 as 30 *a–k* and 32 *a–k* are stamped at intervals $d_1$, as shown on FIG. 15. The distance $d_1$ is 2 inches as an example, however, $d_1$ can be varied as desired to give design flexibility. For example, in countries in which the metric system is used the distance $d_1$ can be varied from about 50 cm to about 100 cm to give a suitable design variability. The metal strip 108 is thereafter fed to a marking device 111 containing three retractable paint wheels 112, 113 and 114. As described with reference to FIG. 21, the paint wheels are lowered at a prescribed location to provide three separate series of indicants. Each indicant is spaced equal distance from an adjacent indicant of the same type as was described with reference to FIG. 21. After indicants have been marked on metal strip by paint wheels the strip is fed to a seaming press that provides seams prior to bending. The flat strip enters a series of bending wheels which in a series of 10 bends changes the profile to a track 10 as shown in profile in FIG. 2. The track is sheared at a predetermined length. The shearing to produce the desired length can be after the bending thus enabling the metal strip to be in tension to convey the material through the various work stations. After the work is performed the formed track can be cut to the desired length $1_1$, such as 12 feet. If desired the flat strip can be cut to length $1_1$ at any location prior to the last forming location. The metal forming production unit can be either self-propelled or can be transported to the job site by an external means such as a tractor.

While there have been shown what are considered to be the preferred embodiments of the invention, other and further modification may occur to those skilled in the art to which the invention pertains.

What is claimed is:

1. A metallic longitudinal track member comprising a) first and second substantially identical and parallel vertical wall sections forming opposing vertical walls of the track member, b) first and second substantially identical horizontal base sections having a first width and projecting at about 90° from corresponding adjacent wall sections at one extremity and along the entire length thereof, c) first and second substantially identical vertical intermediate sections extending the length of the track and projecting from an extremity of adjacent base sections opposite to the respective wall sections and having transverse cross-sections in the shape of sides and the tops of truncated isosceles triangles, each intermediate section having at least one locking slot adapted for receiving and retaining portions of a metallic stud member and d) a third horizontal base section having a second width between the vertical intermediate sections.

2. A metallic track according to claim 1 wherein the locking slots in the first and second intermediate members are aligned in a transverse direction normal to the longitudinal axis of the track.

3. A metallic track according to claim 2 wherein the locking slots comprise a plurality of locking teeth in the sides of each vertical intermediate section.

4. A metallic track according to claim 3 wherein each intermediate section contains a plurality of the locking slots at predetermined locations along the length of the track.

5. A metallic track according to claim 4 wherein adjacent aligned locking slots have an equal distance therebetween.

6. A metallic track according to claim 1 having a distance between the first and second vertical wall sections of about 3.5 to about 4.0 inches.

7. A metallic track according to claim 1 wherein the metal is galvanized steel.

8. A metallic stud member comprising (a) first and second spaced apart parallel wall sections extending the length of the stud member, (b) a transition section connecting the wall sections at one edge of each wall section and containing at least one construction aid, (c) a first flange section extending the length of the first wall section and projecting perpendicular from the other edge of the first wall section and d) a second flange section extending the length of the second wall section and projecting perpendicular from the other edge of the second wall section, wherein an electrical conduit box is secured to the stud member by a pair mounting tabs of the conduit box and without use of a screw or bolt, the mounting tabs bring inserted within a pair vertically aligned slots of the stud member and extending in opposed directions with respect to one another.

9. A metallic stud member according to claim 8 further comprising a construction aid that is a first receiving means capable of receiving and securing a metallic transverse member interconnecting an adjacent transition section of an adjacent stud member.

10. A metallic stud member according to claim 8 wherein the first pair of vertically aligned slots is along one edge of the transition section and a second pair of vertically aligned slots at the opposing edge of the transition section at the first distance from the first end of the stud member.

11. A metallic stud member according to claim 10 having third and fourth pairs of vertically aligned slots substantially identical to the first and second pairs of vertically aligned slots at a second distance from the first end of the stud member.

12. A metallic stud member according to claim 11 wherein the first distance is about 18 inches and the second distance is about 48 inches.

13. A metallic stud member according to claim 8 further comprising a construction aid that is a passageway for enabling an electrical conduit to traverse said stud member.

14. A metallic stud member according to claim 8 further comprising a construction aid that is a pair of slots for receiving and securing end tabs of transverse framing for a wall opening.

15. A metallic stud member according to claim 8 further comprising a construction aid that is an opening at an extremity of the transition section for passage of utility conduits.

16. The metallic stud member of claim 8 wherein the stud member comprises an elliptical-shaped passageway for an electrical conduit.

17. A metallic frame comprising a) a lower track member having a longitudinal axis and comprising i) first and second substantially identical and parallel vertical wall sections forming opposing vertical walls of the track member, ii) first and second substantially identical horizontal base sections having a first width and projecting at about 90° from corresponding adjacent wall sections at one extremity and along the entire length thereof, iii) first and second substantially identical vertical intermediate sections extending the length of the track and projecting from an extremity of adjacent base sections opposite to the respective wall sections and having transverse cross-sections in the shape of sides and the tops of a truncated isosceles triangles, each intermediate section having at least one locking slot, the locking slots being in alignment in a direction transverse and normal to the longitudinal axis of the track member and iv) a third horizontal base section having a second width between the vertical intermediate sections, b) a plurality of vertical stud members transverse to the horizontal axis of the track member and having portions at one end thereof inserted into the locking slot of the lower track member, each stud member comprising, i) first and second spaced apart parallel wall sections extending the height of the stud member, ii) a transition section connecting the wall sections at one edge of each wall section and containing at least one construction aid, iii) a first flange section extending along the first wall section and at about 90° from the other edge of the first wall section and iv) a second flange section extending the length of the second wall section and projecting perpendicular from the other edge of the second wall section one end of each of the first and second flange sections contacting the first and second base sections of the track member and c) an upper track member adapted for receiving and retaining an opposing end of the stud members in a relatively fixed position.

18. A metal frame according to claim 17 wherein the upper track member has the same configuration as the lower track member.

19. A metal frame according to claim 18 wherein the stud members have a first pair of vertically aligned slots for receiving and securing mounting tabs of an electrical conduit box at a first distance from a first end of the stud member, a second pair of vertically aligned slots at the opposing edge of the transition section about 18 inches from the end of the stud member contacting the lower track member, third and fourth pairs of vertically aligned slots substantially identical to the first and second pairs of vertically aligned slots at about 48 inches from the end of the stud member contacting the lower track member.

20. A metal frame according to claim 17 wherein the upper track member comprises a) a first and second parallel walls extending the length of the upper track member, b) a transition section connecting the walls at one edge of each wall, c) a plurality of stud retaining means on the first wall and d) a plurality of stud retaining means on the second wall.

21. A metal frame according to claim 20 wherein the stud retaining means comprise a pair of projections spaced apart by a distance corresponding to the width of the walls of the stud.

22. A metal frame according to claim 17 having a plurality of angle reinforcing members interlocking adjacent stud members.

23. A metal frame according to claim 17 having a wall opening framing member attached to and connecting at least two adjacent stud members wherein the adjacent stud members and the wall opening frame provide framing for an opening in a wall constructed utilizing the metal frame.

24. A metal frame according to claim 17 wherein the stud members have at least one construction aid selected from the group consisting of a) means for receiving and securing a metallic transverse member interconnecting an adjacent transition section of an adjacent stud member, b) means for receiving and securing a mounting member for an electrical box, c) passageway for an electrical conduit, d) means for receiving and securing transverse wall opening framing and e) an opening abutting a track member at an end of the transition section.

25. A metallic stud member with an attached electrical conduit box comprising a stud member having a pair of vertically aligned slots at a first distance from a first end of the stud member, and the electrical conduit box comprising a pair outwardly extending first and second tabs adapted for insertion into the stud member slots, the first tabs extending outwardly from a first side of a face of the conduit box, the second tabs extending outwardly in an opposed direction with respect to the first tab and from a second side of the conduit box face, and wherein the pair of outwardly extending first and second mounting tabs are inserted within the pair of vertically aligned slots.

* * * * *